United States Patent [19]

Taguchi

[11] Patent Number: 4,780,059

[45] Date of Patent: Oct. 25, 1988

[54] SLANT PLATE TYPE COMPRESSOR WITH VARIABLE CAPACITY MECHANISM WITH IMPROVED COOLING CHARACTERISTICS

[75] Inventor: Yokihiko Taguchi, Maebashi, Japan

[73] Assignee: Sanden Corporation, Gunma, Japan

[21] Appl. No.: 75,968

[22] Filed: Jul. 21, 1987

[30] Foreign Application Priority Data

Jul. 21, 1986 [JP] Japan ..... 61-169897

[51] Int. Cl.[4] ..... F04B 1/26; F04B 49/00

[52] U.S. Cl. ..... 417/222; 417/270; 417/282

[58] Field of Search ..... 417/222, 270, 282

[56] References Cited

U.S. PATENT DOCUMENTS

| | | | |
|---|---|---|---|
| Re. 27,844 | 12/1973 | Olsen | 417/269 |
| 862,867 | 8/1907 | Eggleston | 417/472 X |
| 2,530,507 | 11/1950 | Campbell . | |
| 2,573,863 | 11/1951 | Mitchell . | |
| 2,964,234 | 12/1960 | Loomis | 74/60 |
| 3,861,829 | 1/1975 | Roberts et al. | 417/270 X |
| 4,037,993 | 7/1977 | Roberts | 417/222 |
| 4,073,603 | 2/1978 | Abendschein et al. | 417/222 |
| 4,145,163 | 3/1979 | Fogelberg et al. | 417/222 |
| 4,174,191 | 11/1979 | Roberts | 417/222 |
| 4,425,837 | 1/1984 | Livesay | 417/269 X |
| 4,428,718 | 1/1984 | Skinner | 417/222 |
| 4,433,596 | 2/1984 | Scalzo | 417/222 X |
| 4,475,871 | 10/1984 | Roberts | 417/222 |
| 4,492,527 | 1/1985 | Swain et al. | 417/222 |
| 4,526,516 | 7/1985 | Swain et al. | 417/222 |
| 4,606,705 | 8/1986 | Parekh | 417/270 X |
| 4,669,272 | 6/1987 | Kawai et al. | 417/270 X |
| 4,687,419 | 8/1987 | Suzuki et al. | 417/270 X |
| 4,688,997 | 8/1987 | Suzuki et al. | 417/222 |

FOREIGN PATENT DOCUMENTS

| | | | |
|---|---|---|---|
| 51181 | 3/1984 | Japan | 417/282 |
| 55380 | 3/1986 | Japan | 417/222 |
| 145379 | 7/1986 | Japan | 417/222 |
| 2153922A | 8/1985 | United Kingdom | 417/222 |

*Primary Examiner*—Carlton R. Croyle
*Assistant Examiner*—Paul F. Neils
*Attorney, Agent, or Firm*—Banner, Birch, McKie & Beckett

[57] ABSTRACT

This invention is directed to a slant plate type compressor, such as a wobble plate type compressor, which is provided with a variable displacement mechanism. The variable displacement mechanism controls the incline angle of the wobble plate due to changes in crank chamber pressure. The variable displacement mechanism comprises a passageway communicating between the suction chamber and the crank chamber, and a valve mechanism to control the opening and closing of the passageway. The valve mechanism includes a first valve control mechanism for directly controlling the opening and closing of passageway and a second valve control mechanism which operates to override the first valve mechanism and open the passageway to operate the compressor at high capacity.

8 Claims, 5 Drawing Sheets

SLANT PLATE TYPE COMPRESSOR WITH VARIABLE CAPACITY MECHANISM WITH IMPROVED COOLING CHARACTERISTICS

TECHNICAL FIELD

The present invention relates to a refrigerant type compressor for an automotive air conditioner. More particularly, the present invention relates to a slant plate type compressor such as a wobble plate type compressor with a variable capacity mechanism which has effective cooling characteristics.

BACKGROUND OF THE INVENTION

One construction of a slant plate type compressor, particularly a wobble plate type compressor, with a variable capacity mechanism which is suitable for use in an automotive air conditioner is disclosed in U.S. Pat. No. 3,861,829 issued to Roberts et al. Roberts et al. '829 discloses a wobble plate type compressor which has a cam rotor driving device to drive a plurality of pistons. The slant or inclined angle of the slant surface of of the wobble plate is varied to change the stroke length of the pistons which changes the displacement of the compressor. Changing the incline angle of the wobble plate is effected by changing the pressure difference between the suction chamber and the crank chamber. This pressure difference is effected by adjusting the pressure in the crank chamber.

Roberts et al. '829 discloses a capacity adjusting mechanism used in a wobble plate type compressor. As is typical in this type of compressor, the wobble plate is disposed at a slant or incline angle relative to the drive axis, nutates but does not rotate, and drivingly couples the pistons to the drive source. This type of capacity adjusting mechanism, using selective fluid communication between the crank chamber and the suction chamber, can be used in any type of compressor which uses a slanted plate or surface in the drive mechanism. For example, U.S. Pat. No. 4,664,604 issued to Terauchi discloses this type of capacity adjusting mechanism in a swash plate type compressor. The swash plate, like the wobble plate, is disposed at a slant angle and drivingly couples the pistons to the drive source. However, while the wobble plate only nutates, the swash plate both nutates and rotates. The term slant plate type compressor will therefore be used to refer to any type of compressor, including wobble and swash plate types, which use a slanted plate or surface in the drive mechanism.

Referring to FIG. 1, a construction of a wobble plate type compressor is shown. The compressor includes compressor housing 1 having cylinder block 2 which is provided with a plurality of cylinder 22 and crank chamber 3. Cylinder head 4 is mounted on one end portion of cylinder block 2 through valve plate 5. Drive shaft 6 is rotatably supported on tubular extension 11 through bearing 7. Tubular extension 11 is formed on the compressor at its end opposite valve plate 5. The inner terminal end of drive shaft 6 exends within crank chamber 3 and is rotatably supported in central hole 21 of cylinder block 2 through bearing 8.

Rotor 9 is connected to drive shaft 6 and is rotatable with the drive shaft. Rotor 9 engages one side surface of inclined plate 10 through hinge mechanism 91. The angle of inclined plate 10 with respect to drive shaft 6 can be adjusted by hinge mechanism 91. The other side surface of inclined plate 10 is disposed on wobble plate 12 which is rotatably supported on inclined plate 10.

Thrust bearing 13 is disposed between inclined plate 10 and wobble plate 12. Guide bar 14 axially extends within crank chamber 3 and connects one end of compressor housing 1 with cylinder block 2. The lower end portion of wobble plate 12 engages guide bar 14 so that wobble plate 12 can reciprocate along guide bar 14 while rotational motion of wobble plate 12 is prevented.

A plurality of pistons 15 are slidably fitted within respective cylinders 22 and are connected to wobble plate 12 through connecting rods 16. Cylinder head 4 is divided into suction chamber **4*a* and discharge chamber 4*b***.

Control valve mechanism 17, shown in FIG. 2, is disposed in suction chamber **4*a* and controls the opening and closing of passageway 18 which communicates between crank chamber 3 and suction chamber 4*a*. Control valve mechanism 17 includes first casing 171, second casing 172 which is fixed on one end surface of first casing 171, and bellows 173 which is disposed within the interior of first casing 171 and is held in position by coil spring 174. Bellows 173 is provided with valve portion 173*a* at its outer end surface. A coil spring (not shown) is disposed within bellows 173 to control the expansion and contraction of bellows 173. First casing 171 is provided with first channel 171*a* at its outer peripheral portion to communicate between the interior of first casing 171 and suction chamber 4*a*. Second casing 172 is provided with second channel 172*a* and third channel 172*b*. Second channel 172*a* and third channel 172*b* communicate with crank chamber 3 through passageway 18. Passageway 18 extends through drive shaft 6 as shown in dotted lines in FIG. 1. The arrows illustrate the flow of refrigerant from crank chamber 3 to suction chamber 4*a*. Thus, crank chamber 3 and suction chamber 4*a* communicate with one another through control valve mechanism 17**.

The operation of control valve mechanism 17 is as follows. If the pressure in suction chamber **4*a* exceeds a predetermined value as determined by bellows 173, bellows 173 in first casing 171 contracts, and moves valve portion 173a toward the left in the figure. Accordingly, third channel 172*b* is opened, and crank chamber 3 communicates with suction chamber 4*a* through passageway 18, second channel 172*a*, third channel 172*b*, and first channel 171*a*. Therefore, the pressure in crank chamber 3, which acts on the rear of the pistons, decreases, and the incline angle of wobble plate 12 increases. As a result, the stroke volume of pistons 15** increases, and the capacity of the compressor also increases.

Conversely, if the pressure in suction chamber **4*a* is below the predetermined value, bellows 173 in first casing 171 expands, and moves valve portion 173*a* toward the right in the figure. Accordingly, third channel 172*b* is closed, and there is no communication between crank chamber 3 and suction chamber 4*a*. The pressure in crank chamber 3 thus gradually increases due to the leakage of blow-by gas from cylinders 22. Therefore, the pressure on the rear of the pistons increases, and the incline angle of wobble plate 12 decreases. As a result, the stroke volume of pistons 15** decreases, and the capacity of the compressor decreases.

In an automotive air conditioning system which uses the above discussed compressor, if the compressor begins operation when the thermal load in the passenger compartment of the vehicle is large and the engine is driven at high speeds, the pressure in the suction chamber of the compressor is below the predetermined value of the control mechanism. Thus, the capacity of the compressor is inadequate as the suction pressure is less than the predetermined value and there is no fluid communication between the crank chamber and the suction chamber. Due to this fluid communication, the capacity decreases when increased capacity is desired. Therefore, the capacity control mechanism of the compressor operates in spite of the insufficient decrease in the temperature in the passenger compartment of the car. Thus, the ability to cool is not good as in a conventional wobble plate type compressor without a variable capacity mechanism.

SUMMARY OF THE INVENTION

It is a primary object of this invention to provide a slant plate type compressor with a variable capacity mechanism which can more accurately control the temperature in a passenger compartment of a vehicle.

It is another object of this invention to provide a slant plate type compressor such as a wobble plate type compressor with a variable capacity mechanism which has improved cooling characteristics.

A slant plate type compressor in accordance with the present invention includes a compressor housing having a front end plate at one of its ends and a rear end plate at its other end. A crank chamber and a cylinder block are located in the housing, and a plurality of cylinders are formed in the cylinder block. A piston is slidably fitted within each of the cylinders and is reciprocated by a driving mechanism. The driving mechanism includes a drive shaft, a drive rotor coupled to the drive shaft and rotatable therewith, and a coupling mechanism which drivingly couples the rotor to the pistons such that the rotary motion of the rotor is converted to reciprocating motion of the pistons. The coupling mechanism includes a member which has a surface disposed at an incline angle relative to the drive shaft. The incline angle of the member is adjustable to vary the stroke length of the reciprocating pistons and thus vary the capacity or displacement of the compressor. The rear end plate surrounds a suction chamber and a discharge chamber. A passageway provides fluid communication between the crank chamber and the suction chamber. A variable capacity control device is supported in the rear end plate of the compressor and controls fluid communication between the crank chamber and the suction chamber through the passageway, and includes first and second valve control mechanisms. The first valve control mechanism controls the operation of a valve element to open and close the passageway in response to the refrigerant in the compressor. The second valve control mechanism is coupled to the first valve control mechanism and overrides the first valve control mechanism to open the passageway in certain situations.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF PREFERRED EMBODIMENTS

Figure 1:
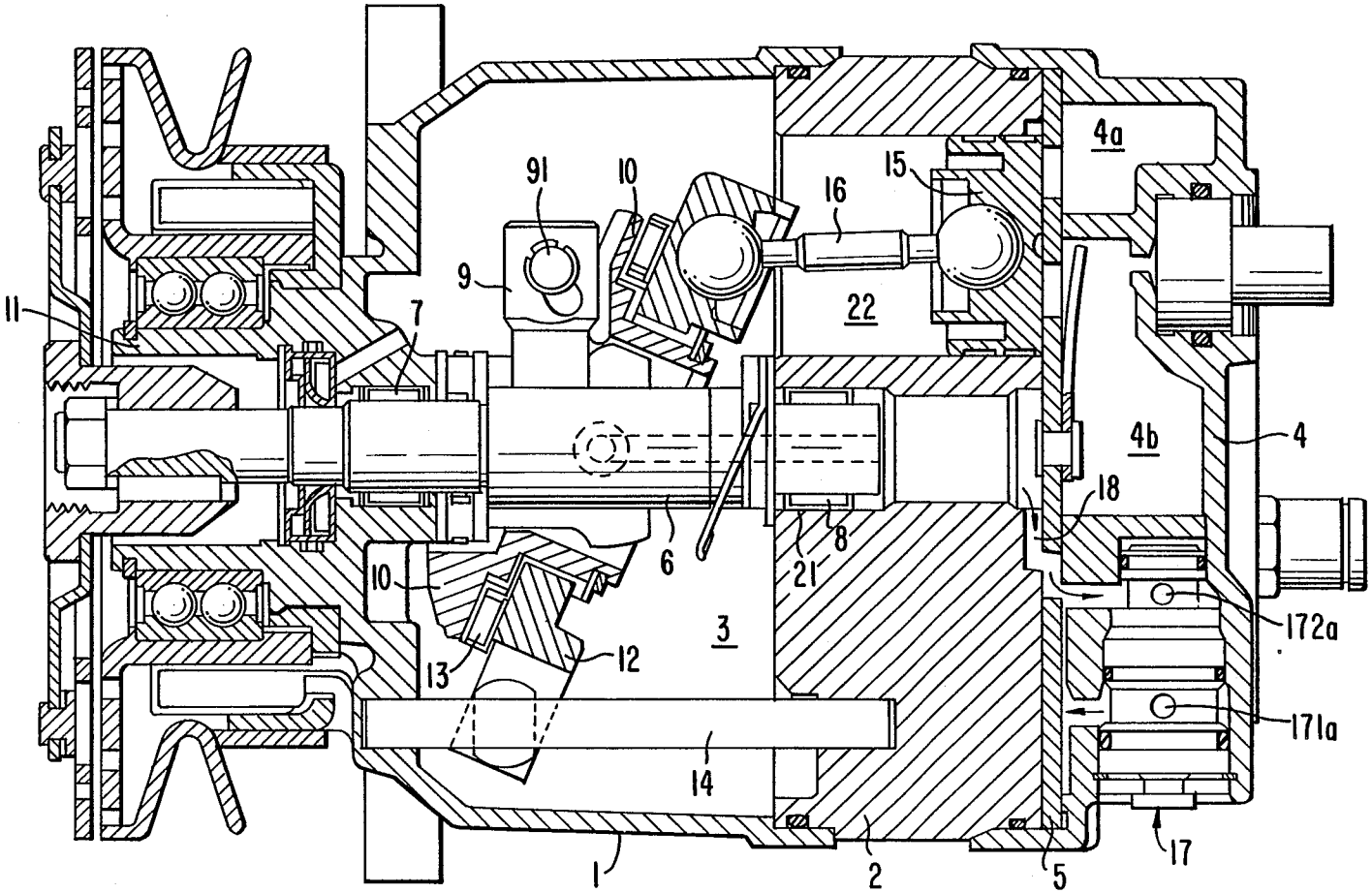
FIG. 1 is a cross-sectional view of a wobble plate type compressor with a variable capacity mechanism.
Figure 3:
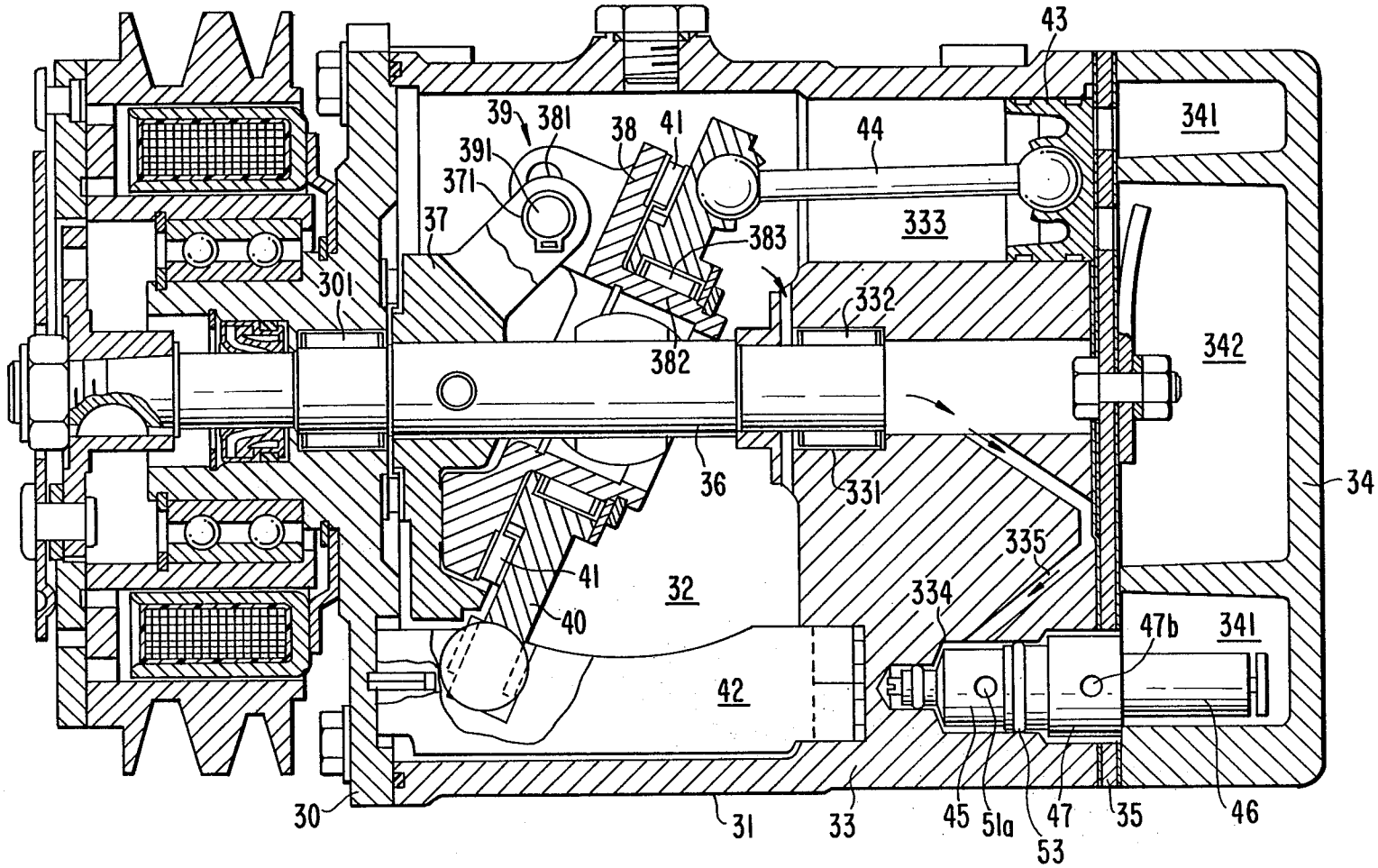
FIG. 3 is a cross-sectional view of a wobble plate type compressor with a variable capacity mechanism in accordance with one embodiment of this invention.

With reference to FIG. 3, the construction of a wobble plate type compressor with a variable capacity mechanism in accordance with one embodiment of this invention is shown. This compressor is a slightly modified version of the compressor of FIG. 1, although both compressors operate in generally the same manner. The compressor includes front end plate 30 and compressor housing 31 which is provided with crank chamber 32 and cylinder block 33. Cylinder head 34 is attached on one end surface of cylinder block 33 through valve plate 35 by securing belts (not shown).

Drive shaft 36 is rotatably supported at one end within front end plate 30 through bearing 301. Drive shaft 36 extends into central aperture 331 of cylinder block 33 at its other end which is rotatably supported through bearing 332. Rotor 37 is fixedly disposed on the outer terminal end of drive shaft 36 and is connected to inclined plate 38 through hinge mechanism 39. Inclined plate 38 is axially and movably disposed on the outer surface of drive shaft 36 and rotates together with rotor 37. Hinge mechanism 39 includes pin 391 which is fixed within hole 371 of rotor 37 and longitudinal hole 381 of inclined plate 38 to operate inclined plate 38 axially.

Wobble plate 40 is placed in close proximity to the surface of inclined plate 38 and is radially supported on the outer surface of tubular portion 382 of inclined plate 38 through bearing 383. Thrust needle bearing 41 is disposed between the sloping surface on inclined plate 38 and wobble plate 40. The lower end portion of wobble plate 40 engages guide bar 42 to enable wobble plate 40 to reciprocate along guide bar 42 while rotating motion is prevented.

A plurality of pistons 43 are slidably fitted within respective cylinders 333 and each of pistons 43 is connected at its other end to wobble plate 40 through respective connecting rods 44. Cylinder block 33 is divided into suction chamber 341 and discharge chamber 342, each of which communicates with a refrigerant circuit through an inlet or outlet port (not shown), respectively.

Control valve mechanism 45 is disposed in cavity 334 of cylinder block 33 and controls the opening and closing of channel 335 which communicates between crank chamber 32 and cavity 334. Electromagnetic actuator 46 projects into suction chamber 341, and is connected to one end of control valve mechanism 45 through bracket 47.

Figure 4:
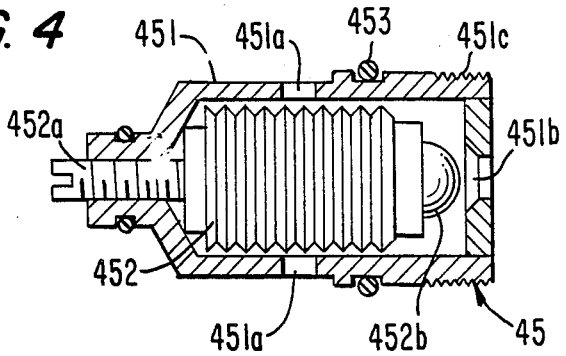
FIG. 4 is a cross-sectional view of a control valve mechanism of the compressor of FIG. 3.

Referring to FIG. 4, the construction of control valve mechanism 45 is shown. Control valve mechanism 45 includes cup-shaped casing 451 which is provided with aperture 451*a* at its peripheral portion to communicate between the interior of casing 451 and crank chamber 32 through channel 335, aperture 451*b*, and bellows 452 which is disposed within the interior of casing 451. O-ring 453 is disposed on the outer surface of casing 451 and seals between the inner surface of cavity 334 and the outer peripheral surface of control valve mechanism 45. Bellows 452 is provided with adjusting screw 452*a* for adjusting the operating point of bellows 452. Adjusting screw 452*a* is attached on the upper end surface of bellows 452. Bellows 452 is also provided with valve portion 452*b* fixed on its lower end surface. In the above construction, communication between crank chamber 32 and suction chamber 341 is controlled in accordance with the operation of control valve mechanism 45.

Figure 5:
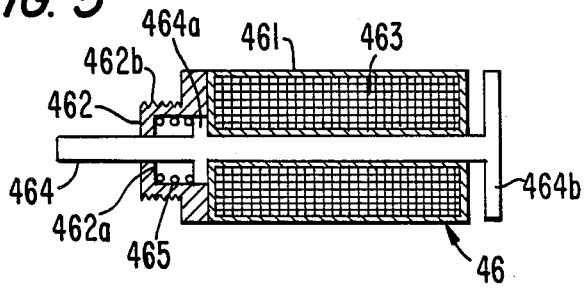
FIG. 5 is a cross-sectional view of an electromagnetic actuator of the compressor of FIG. 3.

The construction of electromagnetic actuator 46 is shown in FIG. 5. Actuator 46 includes casing 461 within which electromagnetic coil 463 is disposed. Frame 462 is attached on one end surface of casing 461 and actuator pin 464 is axially slidably extended within the central aperture of casing 461 and frame 462. Frame 462 is provided with cavity 462*a* and screw thread 462*b* which is formed on the outer surface thereof. Pin 464 is provided with radial flange portion 464*a* which is disposed within cavity 462*a* of connecting frame 462 for receiving the recoil strength of coil spring 465. Pin 464 is also provided with armature portion 464*b* which is attracted to electromagnetic coil 463 when electromagnetic coil 463 is supplied with electric current.

Figure 6:
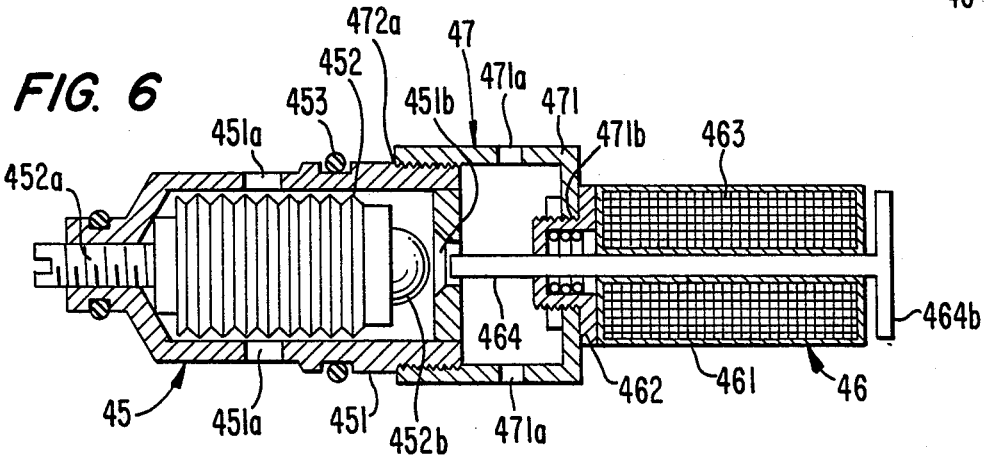
FIG. 6 is a cross-sectional view of a variable capacity mechanism of the compressor of FIG. 3 which includes the control valve mechanism of FIG. 4 and the electromagnetic actuator of FIG. 5.

Referring to FIG. 6, the construction of the variable capacity mechanism including control valve mechanism 45 and electromagnetic actuator 46 is shown. Control valve mechanism 45 and electromagnetic actuator 46 are connected through bracket 47. Bracket 47 includes cup-shaped casing 471 which is provided with aperture 471*a* for communicating between suction chamber 341 and the interior of casing 471, and aperture 471*b* for receiving screw thread 462*b* of frame 462. Opening 472 of cup-shaped casing 471 is threaded on threaded portion 451*c* of casing 451. Control valve mechanism 45 and electromagnetic actuator 46 are connected to each other through bracket 47 by securing screw threads 451*c* and 462*b*.

In operation, control valve mechanism 45 and electromagnetic actuator 46 operate to equalize suction pressure by detecting the pressure in crank chamber 32. That is, if the pressure in crank chamber 32 exceeds the predetermined value as determined by bellows 452, bellows 452 contracts and aperture 451*b* of casing 451 is opened. Accordingly, suction chamber 341 communicates with crank chamber 32 through channel 335 formed within cylinder block 33. There pressure on the rear side of pistons 43 gradually decreases, and the incline angle of wobble plate 40 relative to drive shaft 36 increases. Therefore, the stroke of piston 43 in cylinder 333 increases, and the capacity of the compressor increases.

On the other hand, if the pressure in crank chamber 32 is less than the predetermined value, bellows 452 expands and closes aperture 451*b* of casing 451. Accordingly, communication between suction chamber 341 and crank chamber 32 is obstructed, and the pressure on the rear side of pistons 48 increases due to blow-by gas from piston cylinders 333. The incline angle of wobble plate 40 decreases in accordance with the increase in the pressure in crank chamber 32. Therefore, the stroke of piston 43 also decreases, and the capacity of the compressor decreases.

As explained, control valve mechanism 45 operates in accordance with the pressure in crank chamber 32 to adjust the incline angle of wobble plate 40. That is, the stroke of piston 43 is controlled by the pressure in crank chamber 32.

When electromagnetic coil 463 is energized, it generates an electromagnetic force and attracts armature portion 464*b* of actuator pin 464 toward casing 461. Accordingly, actuator pin 464 moves upwardly against the recoil strength of coil spring 465. When the pressure in crank chamber 32 is less than the predetermined value, bellows 452 extends downwardly to close aperture 451*b*. However, actuator pin 464 pushes valve portion 452*b* of bellows 452 upwardly to open aperture 451*b*. Thus, when electromagnetic coil 463 is energized, aperture 451*b* is forcibly opened despite the operation of control valve mechanism 45. On the other hand, when electromagnetic coil 463 is not energized, actuator pin 464 moves downwardly and bellows 452 operates normally. The operation of electromagnetic actuator 46 enables the compressor to operate at high capacity when necessary, even when the crank chamber pressure is less than the predetermined value.

Figure 7:
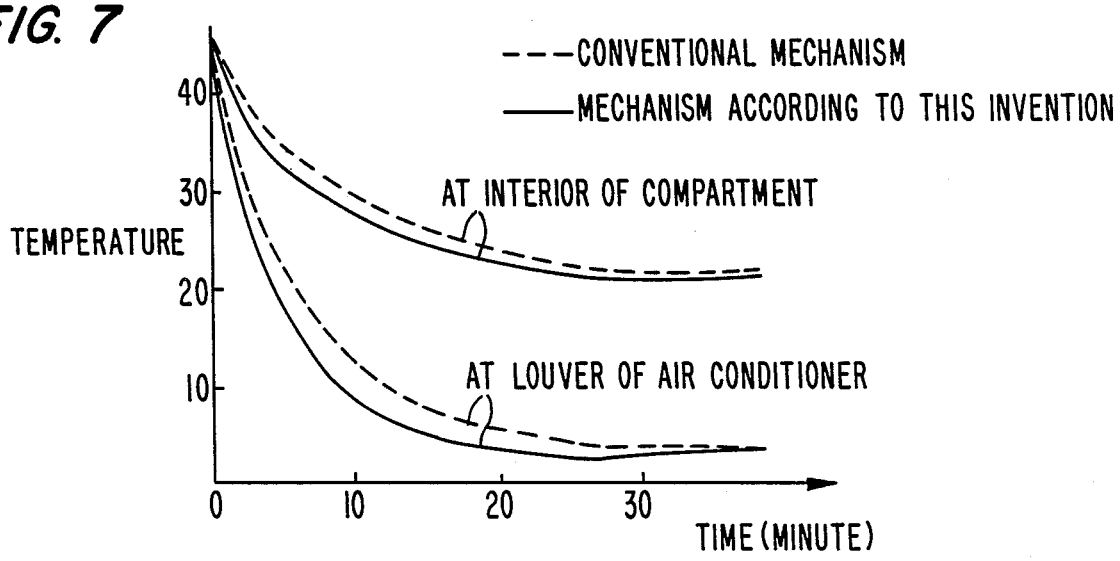
FIG. 7 is a graph which shows the relationship between time and temperature for cooling by a wobble plate type compressor with a conventional variable capacity mechanism as compared with a wobble plate type compressor with a variable capacity mechanism according to the present invention.

Referring to FIG. 7, the relationship between the cooling characteristics for a wobble plate type compressor with a conventional variable capacity mechanism versus a variable capacity mechanism in accordance with the present invention is shown. This graph compares the temperatures in the passenger compartment of a car and of the air blown from a louver. Dotted lines show the temperature using a conventional variable capacity mechanism and solid lines show the temperature using a variable capacity mechanism in accordance with the present invention. This graph indicates that the mechanism in accordance with the present invention has better cooling characteristics than the conventional mechanism at both locations.

Figure 2:
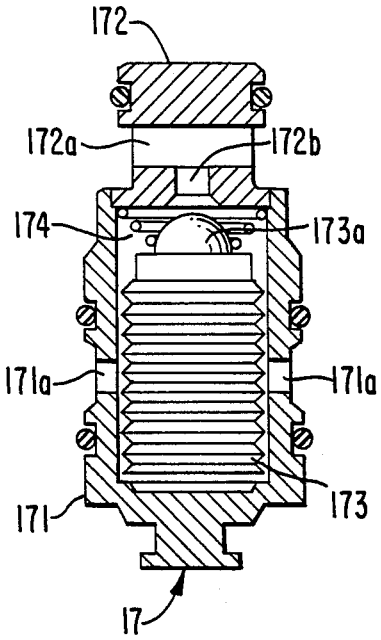
FIG. 2 is a cross-sectional view of the variable capacity mechanism of the wobble plate type compressor of FIG. 1.
Figure 9:
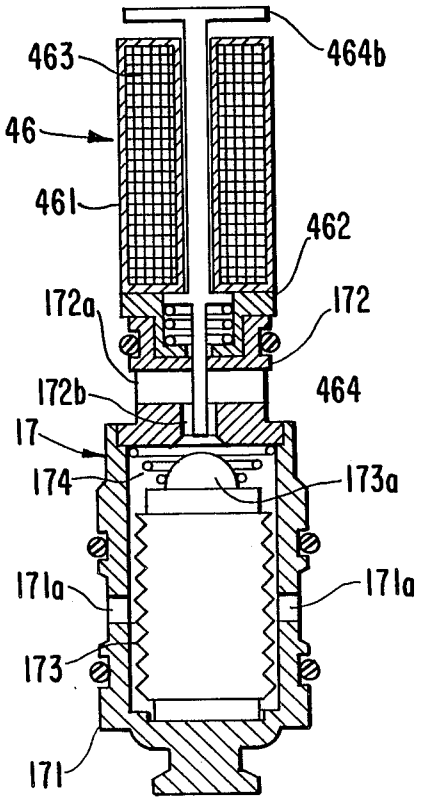
FIG. 9 is a cross-sectional view of a variable capacity mechanism of the compressor of FIG. 8.
Figure 8:
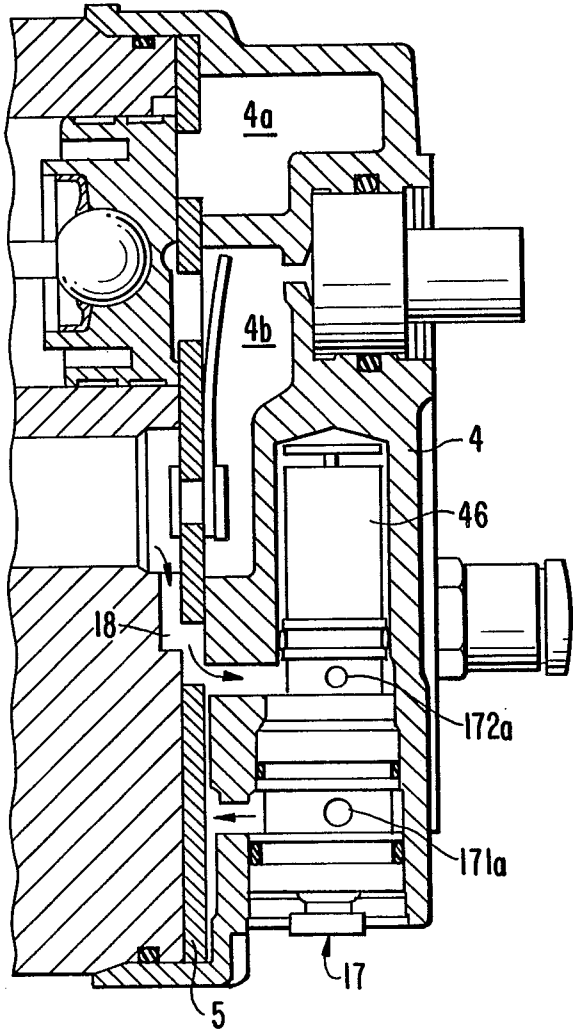
FIG. 8 is a partial cross-sectional view of a wobble plate type compressor with a variable capacity mechanism according to another embodiment of the present invention.
Figure 11:
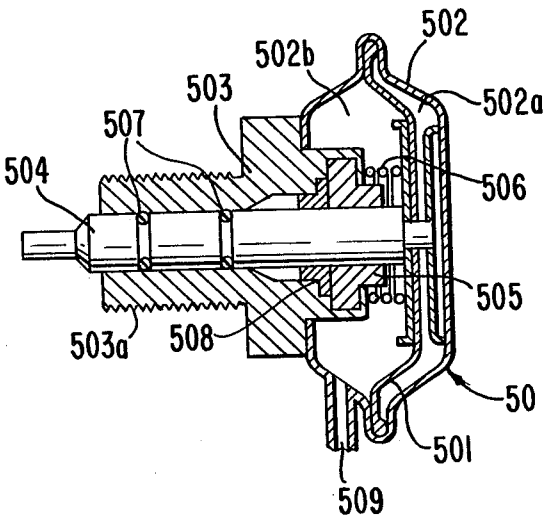
FIG. 11 is a cross-sectional view of a vacuum actuator of the compressor of FIG. 10.

As explained with reference to FIG. 3 to 6, bellows 452 is disposed in the space acted on by the pressure of crank chamber 32, and the pressure of suction chamber 341 acts on valve portion 452*b* of bellows 452. Alternatively, bellows 452 may be disposed in the space acted on by the pressure of suction chamber 341, with the pressure of crank chamber 32 acting on valve portion 452*b* of bellows 452, as shown in FIG. 8. Bellows 452 expands and contracts based on whether the suction pressure is greater than or less than the predetermined value. The construction of the control valve mechanism in this embodiment is similar to control valve mechanism 17 which is explained with reference to FIG. 2. The compressor in FIG. 8 is the embodiment illustrated in FIG. 1. In this embodiment, as shown in FIG. 9, control valve mechanism 17 is provided with electromagnetic actuator 46 of FIG. 5. Therefore, the incline angle of wobble plate 12 varies in accordance with the operation of control valve mechanism 17, as previously explained. Furthermore, when electromagnetic actuator 46 is energized, the compressor is operated at high capacity.

Figure 10:
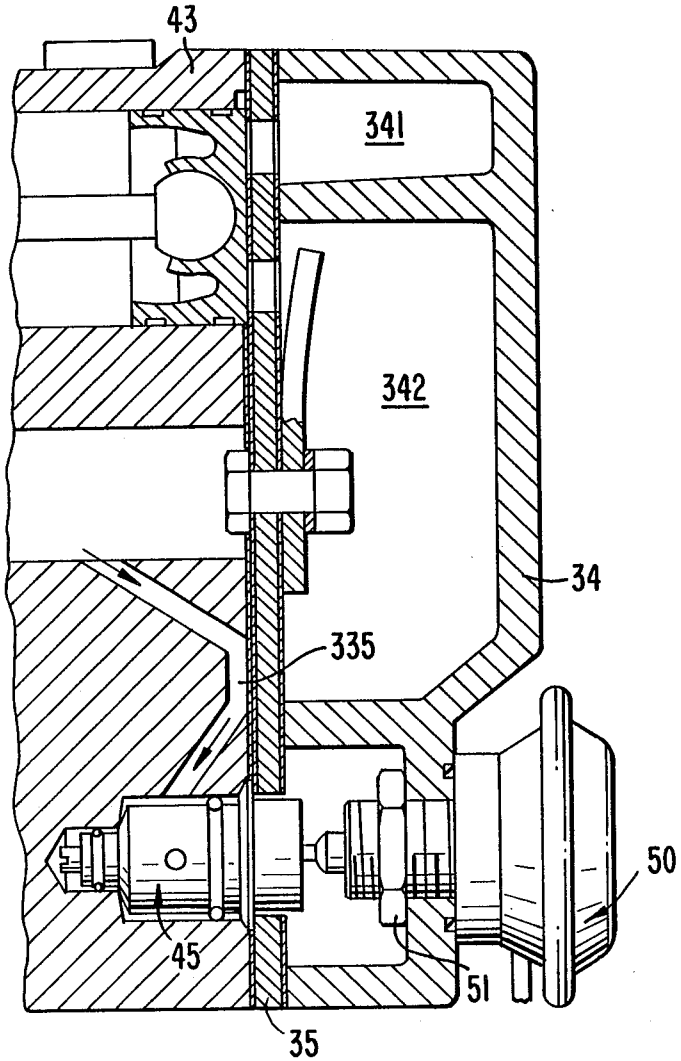
FIG. 10 is a cross-sectional view of a wobble plate type compressor according to another embodiment of this invention.

As shown in FIG. 10, in which the compressor of FIG. 3 is shown, vacuum actuator 50 can replace electromagnetic actuator 46. Vacuum actuator 50 includes a casing 502 which is divided into air chamber 502*a* and negative pressure chamber 502*b* by diaphragm 501. Tubular extension 503 is connected to casing 502. Operating pin 504 is reciprocally disposed within tubular extension 503 and is fixed on diaphragm 501. Tubular extension 503 is provided with stopper portion 505 for limiting the axial moving range of operating pin 504 at the inner end portion thereof. Coil spring 506 is disposed between stopper portion 505 and diaphragm 501 for supporting diaphragm 501 in a stationary position. O-rings 507 and packing 508 are disposed on the outer surface of operating pin 504 for sealing between operating pin 504 and tubular extension 503. Screw thread 503*a* is formed on the outer surface of tubular extension 503 in order to fix vacuum actuator 50 within cylinder head 34 with nut 51.

When vacuum actuator 50 is in place, the outer terminal end of operating pin 504 opposes valve portion 452*b* of bellows 452. In operation, if negative pressure is introduced into the interior of negative pressure chamber 502*b* through introduction tube 509, diaphragm 501 is attracted toward negative pressure chamber 502*b* and contacts stopper portion 505. This moves upwardly operating pin 504 together with diaphragm 501, and the upper end of operating pin 504 pushes valve portion 452*b* of bellows 452 upwardly. Thus, aperture 451*b* is forced open despite the operation of control valve mechanism 45. Therefore, crank chamber 32 communicates with suction chamber 341, the stroke of piston 43 can be maintained at its maximum, and the compressor is operated at high capacity.

On the other hand, when air is introduced into the interior of negative pressure chamber 502*b* through introduction tube 509, diaphragm 501 is forced to return due to the recoil strength of coil spring 506. Accordingly, operating pin 504 moves downwardly together with diaphragm 501. Therefore, control valve mechanism 45 operates normally.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

We claim:

1. In a slant plate type refrigerant compressor for use in a refrigeration circuit, said compressor including a compressor housing having a central portion, a front end plate at one end and a rear end plate at its other end, said housing having a cylinder block provided with a plurality of cylinders and a crank chamber adjacent said cylinder block, a piston slidably fitted within each of said cylinders, a drive mechanism coupled to said pistons to reciprocate said pistons within said cylinders, said drive mechanism including a drive shaft rotatably supported in said housing, a rotor coupled to said drive shaft and rotatable therewith, and coupling means for drivingly coupling said rotor to said pistons such that the rotary motion of said rotor is converted into reciprocating motion of said pistons, said coupling means including a member having a surface disposed at an incline angle relative to said drive shaft, said incline angle of said member being adjustable in response to changes in the crank chamber pressure to vary the stroke length of said pistons and the capacity of the compressor, said rear end plate having a suction chamber and a discharge chamber, a passageway connected between said crank chamber and said suction chamber, and variable capacity control means for controlling the closing and opening of said passageway to control communication between said suction and said crank chambers to vary the capacity of said compressor by adjusting the incline angle, said variable capacity control means including a valve element to directly open and close said passageway, the improvement comprising:

said variable capacity control means further comprising first valve control means for controlling movement of said valve element to open and close said passageway in response to changes of refrigerant pressure in the compressor; and second valve control means coupled to said first valve control means for opening said passageway and operating said compressor at high capacity despite movement of said first valve control means which would otherwise cause said compressor to operate at a lower capacity.

2. The refrigerant compressor of claim 1 wherein said member comprises an inclined plate and said coupling means further comprises a wobble plate disposed adjacent said inclined plate.

3. The refrigerant compressor of claim 1 wherein said first valve control means comprises a bellows.

4. The refrigerant compressor of claim 3 wherein said second valve control means is an electromagnetic actuator.

5. The refrigerant compressor of claim 3 wherein said second valve control means is a vacuum actuator.

6. The refrigerant compressor of claim 3 wherein said bellows comprises a valve element and said valve element of said bellows opens and closes based on the suction pressure.

7. The refrigerant compressor of claim 3 wherein said bellows comprises a valve element and said valve element of said bellows opens and closes based on the crank chamber pressure.

8. The refrigerant compressor of claim 1 wherein said second control valve means forcibly opens said passageway by pushing said valve element away from said passageway despite opposing forces from said first valve control means

* * * * *